US011658434B2

(12) United States Patent
Shen et al.

(10) Patent No.: US 11,658,434 B2
(45) Date of Patent: May 23, 2023

(54) ELECTRICAL CONNECTING ASSEMBLY AND ELECTRICAL CONNECTOR

(71) Applicant: Xuancheng Luxshare Precision Industry Co., Ltd., Xuancheng (CN)

(72) Inventors: RongXin Shen, Xuancheng (CN); XingRan Tang, Xuancheng (CN); YunBo Linghu, Xuancheng (CN)

(73) Assignee: Xuancheng Luxshare Precision Industry Co., Ltd., Xuancheng (CN)

( * ) Notice: Subject to any disclaimer, the term of this patent is extended or adjusted under 35 U.S.C. 154(b) by 0 days.

(21) Appl. No.: 17/501,510

(22) Filed: Oct. 14, 2021

(65) Prior Publication Data

US 2022/0384981 A1 Dec. 1, 2022

(30) Foreign Application Priority Data

May 26, 2021 (CN) ..... 202110578640.0

(51) Int. Cl.
*H01R 13/187* (2006.01)
*H01R 13/26* (2006.01)

(52) U.S. Cl.
CPC ..... *H01R 13/187* (2013.01); *H01R 13/26* (2013.01)

(58) Field of Classification Search
None
See application file for complete search history.

(56) References Cited

U.S. PATENT DOCUMENTS 7,150,660 B2 * 12/2006 Allgood ..... H01R 13/113 439/852
8,591,258 B2 * 11/2013 Xiao ..... H01R 12/724 439/607.25
10,218,105 B2 * 2/2019 Stange ..... H01R 13/22
2014/0287633 A1 9/2014 Ahangar et al.
(Continued)

FOREIGN PATENT DOCUMENTS

CN 1930741 B 7/2010
CN 102265463 A 11/2011
(Continued)

*Primary Examiner* — Ross N Gushi
(74) *Attorney, Agent, or Firm* — Birch, Stewart, Kolasch & Birch, LLP

(57) ABSTRACT

The embodiments of the present disclosure provide an electrical connecting assembly and an electrical connector. The electrical connecting assembly comprises two electrical connecting parts and a bending part. Each of the electrical connecting assemblies comprises a main body and a securing component. The main body comprises an electrical contacting component. The securing component is disposed at a side edge of the main body. Two bent sides of the bending part are the two electrical connecting parts extending in one direction. The two electrical connecting parts are symmetrically disposed across the bending part. The electrical connector comprises a first electrical connector head comprising an electrical connecting notch and the electrical connecting assembly. The electrical connecting assembly is assembled to the electrical connecting notch. The securing component is secured to the first electrical connector head. A second electrical connector head comprises an electrical plugging member assembled in the electrical connecting assembly.

11 Claims, 8 Drawing Sheets

(56) References Cited

U.S. PATENT DOCUMENTS

| | | | |
|---|---|---|---|
| 2017/0093069 | A1 | 3/2017 | Koyama |
| 2020/0395700 | A1 | 12/2020 | Pavlovic et al. |

FOREIGN PATENT DOCUMENTS

| | | | |
|---|---|---|---|
| CN | 203351869 | U | 12/2013 |
| CN | 103579806 | A | 2/2014 |
| CN | 104716540 | A | 6/2015 |
| CN | 106486791 | A | 3/2017 |
| CN | 106486806 | A | 3/2017 |
| CN | 106785570 | A | 5/2017 |
| CN | 108011247 | A | 5/2018 |
| CN | 108598739 | A | 9/2018 |
| CN | 110233375 | A | 9/2019 |
| CN | 209461665 | U | 10/2019 |
| CN | 110416779 | A | 11/2019 |
| CN | 209747767 | U | 12/2019 |
| CN | 110957597 | A | 4/2020 |
| CN | 111653888 | A | 9/2020 |
| CN | 211605458 | U | 9/2020 |
| CN | 112242625 | A | 1/2021 |
| CN | 212751213 | U | 3/2021 |
| DE | 100 14 116 | A1 | 9/2001 |
| EP | 1 089 387 | A2 | 4/2001 |
| EP | 1 428 297 | B1 | 3/2007 |
| EP | 3 136 516 | A1 | 3/2017 |
| KR | 10-2013-0027298 | A | 3/2013 |

* cited by examiner

ELECTRICAL CONNECTING ASSEMBLY AND ELECTRICAL CONNECTOR

CROSS-REFERENCE TO RELATED APPLICATION

This application claims the priority benefit of Chinese Patent Application Serial Number 202110578640.0, filed on May 26, 2021, the full disclosure of which is incorporated herein by reference.

BACKGROUND

Technical Field

The present disclosure relates to the technical field of connector, particularly to an electrical connecting assembly and an electrical connector.

Related Art

In the technical field of automotive industry, the operation of vehicles would affect the electrical conduction terminals for electrical connections in high-power electrical connector components. The operation of the vehicle would cause resonance of components of the electrical connector connected with male part and female part of the electrical connection. The service life of electrical connectors can be seriously affected by heat generated during electric conduction between the male part and the female part of the electrical connection, or fatigue and wear-deteriorated elastic metal sheets of electrical joints of heavily used vehicles that the electrical connector heads are often affected by heat or cold. Thus, the system stability of the equipment connected with electrical connectors is lowered, the service life of the equipment is shortened, and the risk that the equipment is facing is increased.

SUMMARY

The embodiments of the present disclosure provide an electrical connecting assembly and an electrical connector tended to solve the problem that conventional electrical connector heads are affected by cold or heat to cause fatigue and wear-deterioration to the elastic metal sheets, which leads to seriously affected or shortened service life.

On the first aspect, the present disclosure provides an electrical connecting assembly, which comprises two electrical connecting parts and a bending part. Each of the electrical connecting assemblies comprises a main body and a securing component. The main body comprises an electrical contacting component. The securing component is disposed at a side edge of the main body. Two bent sides of the bending part are the two electrical connecting parts extending in one direction. The two electrical connecting parts are symmetrically disposed across the bending part.

In one embodiment, the securing component is arranged on a side edge of the main body away from the bending part.

In one embodiment, the electrical contacting component comprises an orifice part, a plurality of first contacting pieces, and a plurality of second contacting pieces. The plurality of first contacting pieces and the plurality of second contacting pieces are alternately disposed at the orifice part.

In one embodiment, the orifice part comprises a first side edge and a second side edge opposite to the first side edge. One ends of the plurality of first contacting pieces are respectively connected with the first side edge at intervals.

One ends of the plurality of second contacting pieces are respectively connected with the second side edge at intervals. The plurality of first contacting pieces and the plurality of second contacting pieces are alternately arranged to form a stagger-type component.

In one embodiment, one extending ends of the plurality of first contacting pieces comprise a bent contacting part. One extending ends of the plurality of second contacting pieces comprise a bent contacting part.

In one embodiment, an acute angle is formed between the plurality of first contacting pieces and a plane of the orifice part. An acute angle is formed between the plurality of second contacting pieces and a plane of the orifice part.

In one embodiment, the two electrical connecting parts and the bending part are integrally formed.

In one embodiment, a plurality of first guiding contact pieces are disposed at a side edge of the main body away from the bending part, the plurality of first guiding contact pieces being disposed at one side having the bending part; wherein the plurality of first guiding contact pieces extend in a direction facing the bending part and away from the main body.

In one embodiment, a plurality of second guiding contact pieces are disposed at a side edge of the main body away from the bending part.

On the second aspect, the present disclosure provides an electrical connector comprising a first electrical connector head. The first electrical connector head comprises an electrical connecting notch and the electrical connecting assembly according to the first aspect. The electrical connecting assembly is assembled to the electrical connecting notch. The securing component is secured to the first electrical connector head. Wherein a second electrical connector head comprises an electrical plugging member assembled in the electrical connecting assembly. Two side surfaces of the electrical plugging member respectively abut against the electrical contacting components of the two electrical connecting parts.

In one embodiment, the securing component is a securing buckle. An outer sidewall of the first electrical connector head comprises a securing bump. The securing buckle is buckled to the securing bump.

In one embodiment, a plugging end of the electrical plugging member comprises a first side edge and two second side edges adjacent to the first side edge. The electrical plugging member passes through an opening of the electrical connecting assembly away from the bending part to be assembled in the electrical connecting notch in a direction along the first side edge or the second side edge. Wherein the first electrical connector head and the second electrical connector head are in a 180 degrees or 90 degrees assembly.

In one embodiment, the electrical connecting assembly further comprises a plurality of first guiding contact pieces and a second guiding contact piece. The plurality of first guiding contact pieces are disposed at two sides of the second guiding contact piece. The electrical plugging member is assembled in the electrical connecting assembly through one side having the plurality of first guiding contact pieces and the second guiding contact piece. The two side surfaces of the electrical plugging member are respectively in contact with the plurality of first guiding contact pieces and the second guiding contact piece.

In the embodiments of the present disclosure, by assembling the electrical connector to the first electrical connector head through the electrical connecting assembly and assembling the second electrical connector head to the electrical connecting assembly of first electrical connector head, and through the configuration of the above electrical connecting assembly, when components are interconnected and the system is in operation, it is possible to distribute the heat generated by overloaded electric current to reduce the heat generated by corrosion potential and to improve the overall current overload capacity. Thus, the overall service life for electrical connectors can be increased. Besides, the strength of the connection between the first electrical connector head and the second electrical connector head and the stability of the electrical contact can be enhanced by the structural configuration of the electrical connecting assembly.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
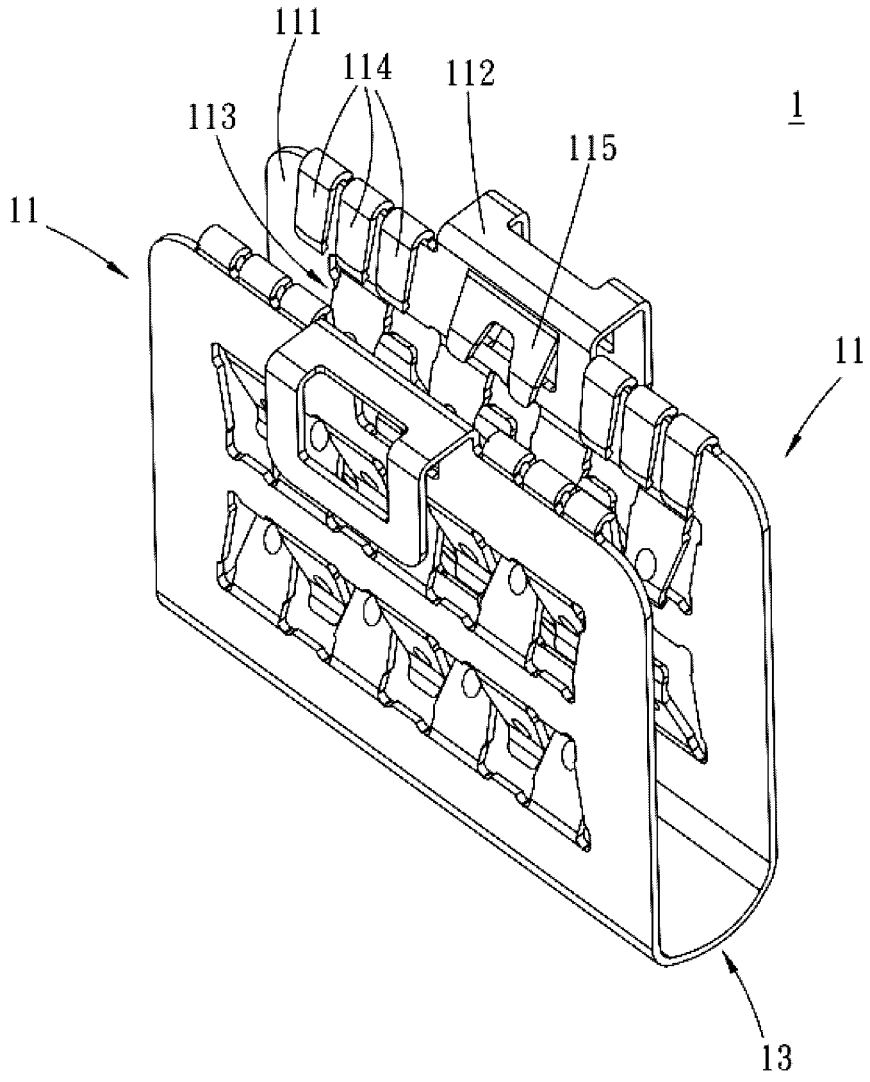
FIG. 1 is a perspective view of an electrical connecting assembly of the present disclosure.
Figure 2:
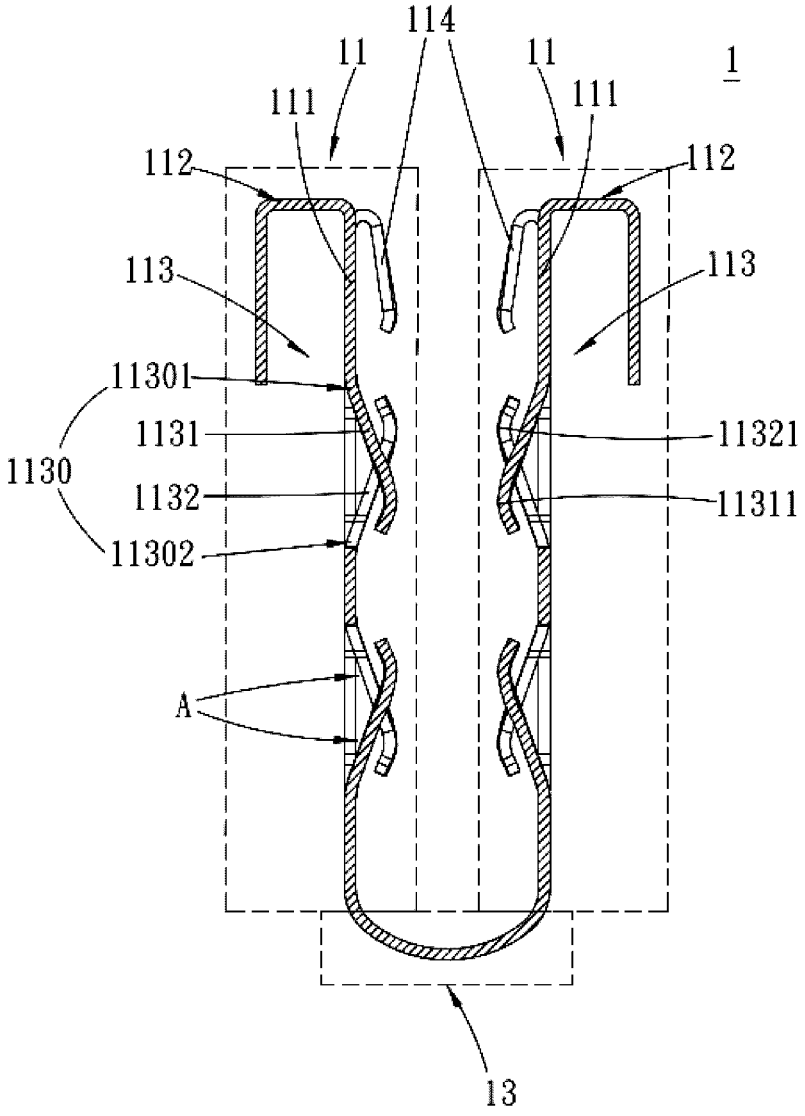
FIG. 2 is a side view of the electrical connecting assembly of the present disclosure.

FIG. 1 and FIG. 2 are perspective view and side view of an electrical connecting assembly of the present disclosure. As shown in the figures, in this embodiment, an electrical connecting assembly 1 is provided, which comprises two electrical connecting parts 11 and a bending part 13. Each of the electrical connecting parts 11 comprises a body 111 and a securing component 112. The main body 111 comprises an electrical contacting component 113, and the securing component 112 is disposed at one side of the main body 111. Two bent sides of the bending part 13 are the two electrical connecting parts 11 extending in one direction. The two electrical connecting parts 11 are symmetrically disposed across the bending part 13. Wherein, the two electrical connecting parts 11 and the bending part 13 are integrally formed so that the overall configuration of the electrical connecting assembly 1 can be U-shaped. The securing component 112 is disposed at one side of the main body 111 away from the bending part 13.

Figure 3:
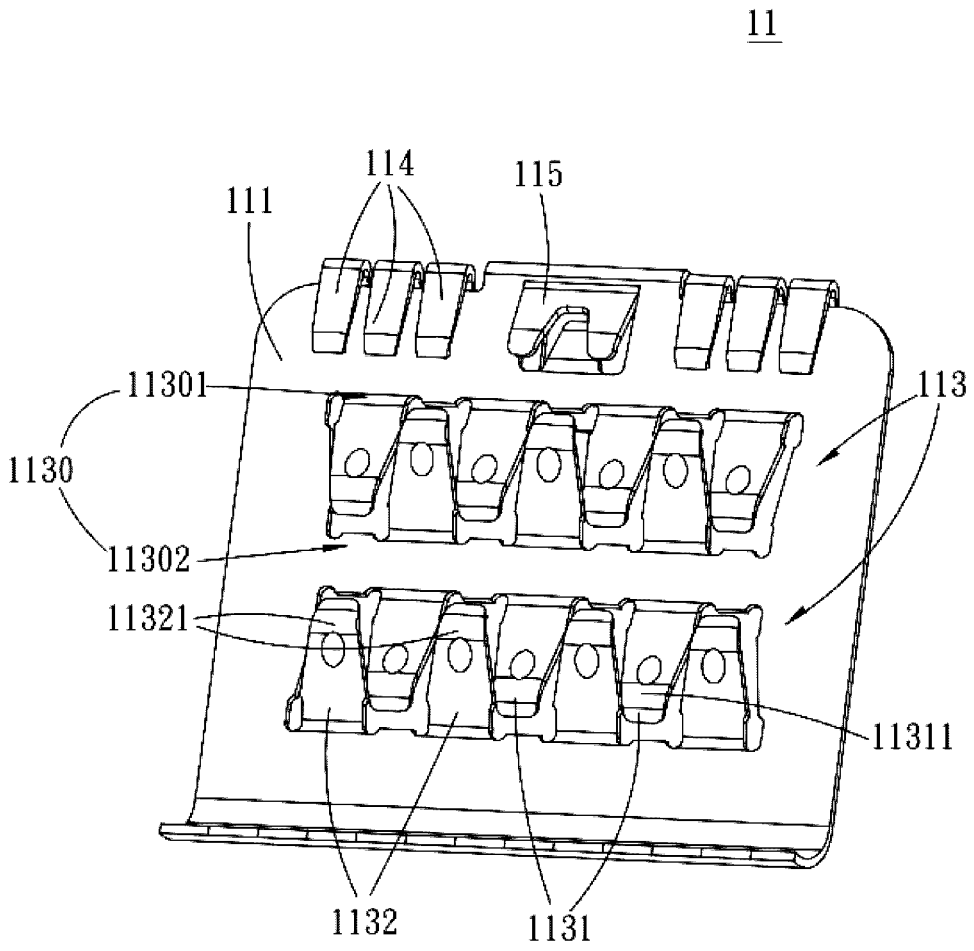
FIG. 3 is an internal view of the electrical connecting assembly of the present disclosure.
Figure 4:
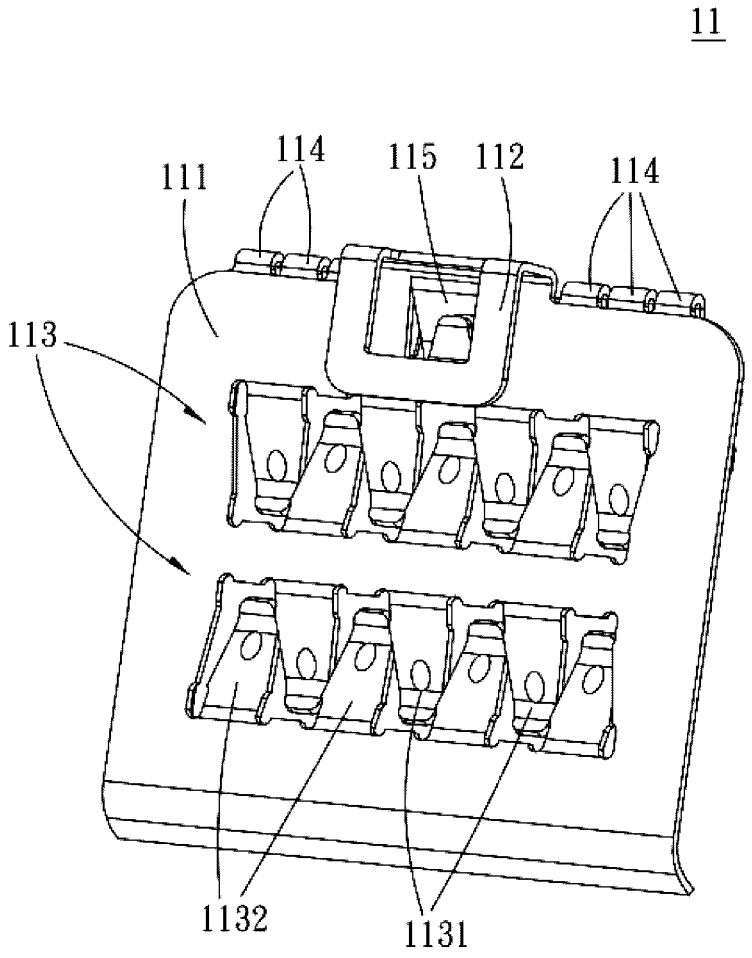
FIG. 4 is an external view of the electrical connecting assembly of the present disclosure.

FIG. 3 and FIG. 4 are internal view and external view of the electrical connecting assembly of the present disclosure. As shown in the figures, in this embodiment, the electrical contacting component 113 comprises an orifice part 1130, a plurality of first contacting pieces 1131, and a plurality of second contacting pieces 1132. The plurality of first contacting pieces 1131 and the plurality of second contacting pieces 1132 are alternately disposed at the orifice part 1130. Wherein the orifice part 1130 comprises a first side edge 11301 and a second side edge 11302 opposite to the first side edge 11301. One ends of the plurality of first contacting pieces 1131 are respectively connected with the first side edge 11301 at interval. The plurality of first contacting pieces 1131 extend in a direction from the first side edge 11301 to the second side edge 11302 at one side with the bending part 13. The extending end of the plurality of first contacting pieces 1131 comprises a bent contacting part 11311.

Besides, one ends of the plurality of second contacting pieces 1132 are respectively connected with the second side edge 11302 at intervals. The plurality of second contacting pieces 1132 extend in a direction from the second side edge 11302 to the first side edge 11301 at one side with the bending part 13. The extending end of the plurality of second contacting pieces 1132 comprises a bent contacting part 11321. In this way, the plurality of first contacting pieces 1131 and the plurality of second contacting pieces 1132 would form a stagger-type configuration.

The plurality of first contacting pieces 1131 extend from the first side edge 11301 to one side having the bending part 13. An acute angle A is formed between the plurality of first contacting pieces 1131 and a plane of the orifice part 1130. The plurality of second contacting pieces 1132 extend from the second side edge 11302 to one side having the bending part 13. An acute angle A is formed between the plurality of second contacting pieces 1132 and a plane of the orifice part 1130. When an electrical plugging member is inserted between the electrical contacting components 113 of the two electrical connecting parts 11, by changing the angle A between the plurality of first contacting pieces 1131 and the orifice part 1130 and between the plurality of second contacting pieces 1132 and the orifice part 1130, the clamping force of the bent contacting parts 11311 of the plurality of first contacting pieces 1131 and the clamping force of the bent contacting parts 11321 of the plurality of second contacting pieces 1132 can be adjusted. Besides, the plurality of first contacting piece 1131 and the plurality of second contacting pieces 1132 are alternately disposed, the clamping force of the electrical connecting assembly 1 clamping the electrical plugging member can be improved.

In this embodiment, the electrical connecting assembly 1 further comprises a plurality of first guiding contact pieces 114 disposed at one side of the main body 111 away from the bending part 13. The plurality of first guiding contact pieces 114 are disposed at one side having the bending part 13, wherein the plurality of first guiding contact pieces 114 extend in a direction toward the bending part 13 and away from the main body 111. The extending direction of the plurality of first guiding contact pieces 114 and the extending direction of the plurality of first contacting pieces 1131 are the same. The plurality of first guiding contact pieces 114 can guide the electrical plugging member inserted in the two electrical connecting parts 11 and can be used as auxiliary clamps for securing the electrical plugging member.

Besides, electrical connecting assembly 1 further comprises a second guiding contact piece 115 disposed oat one side of the main body 111 away from the bending part 13. The second guiding contact piece 115 is formed by stamping a sheet metal at one side having the bending part 13 of the main body 111 and is M shaped, which indicates that the second guiding contact piece 115 comprises two abutting parts. In other words, one side of the second guiding contact piece 115 away from the bending part 13 is connected with the main body 111. The second guiding contact piece 115 works the same as the first guiding contact piece 114. It should be further explained that the electrical connecting assembly 1 provides a stable auxiliary clamping force when assembling and securing the electrical plugging member through a plurality of first guiding contact pieces 114 and the second guiding contact piece 115 to stabilize the connection between the electrical plugging member and itself.

Figure 5:
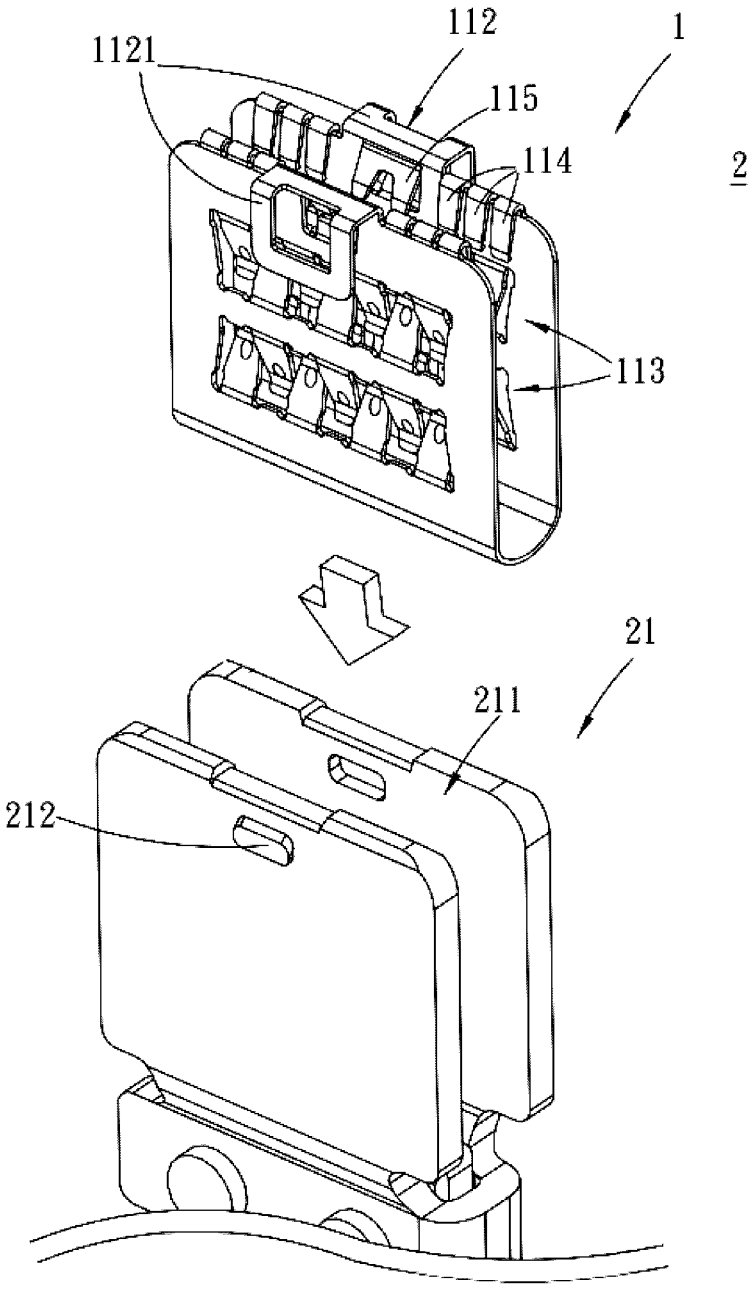
FIG. 5 is a perspective view showing the assembly of the electrical connector head to a first electrical connecting assembly of the present disclosure.

FIG. 5 is a perspective view showing the assembly of the electrical connector head to a first electrical connecting assembly of the present disclosure. As shown in the figure, in this embodiment, an electrical connector 2 is provided, which comprises a first electrical connector head 21. The first electrical connector head 21 comprises an electrical connecting notch 211 and an electrical connecting assembly 1. The electrical connecting assembly 1 is assembled to the electrical connecting notch 211. The two electrical connecting parts 11 and the bending part 13 can be accommodated in the electrical connecting notch 211, and the two electrical connecting parts 11 can be evenly attached to two inner sidewalls of the electrical connecting notch 211. The electrical contacting components 113 of the electrical connecting part 11 extend toward the center part of the electrical connecting notch 211. The securing component 112 secures the first electrical connector head 21, wherein the securing component 112 is a securing buckle 1121, an outer sidewall of the first electrical connector head 21 comprises a securing bump 212, and the securing buckle 1121 is buckled to the securing bump 212 to stable the connection between the first electrical connector head 21 and the electrical connecting assembly 1.

Figure 6:
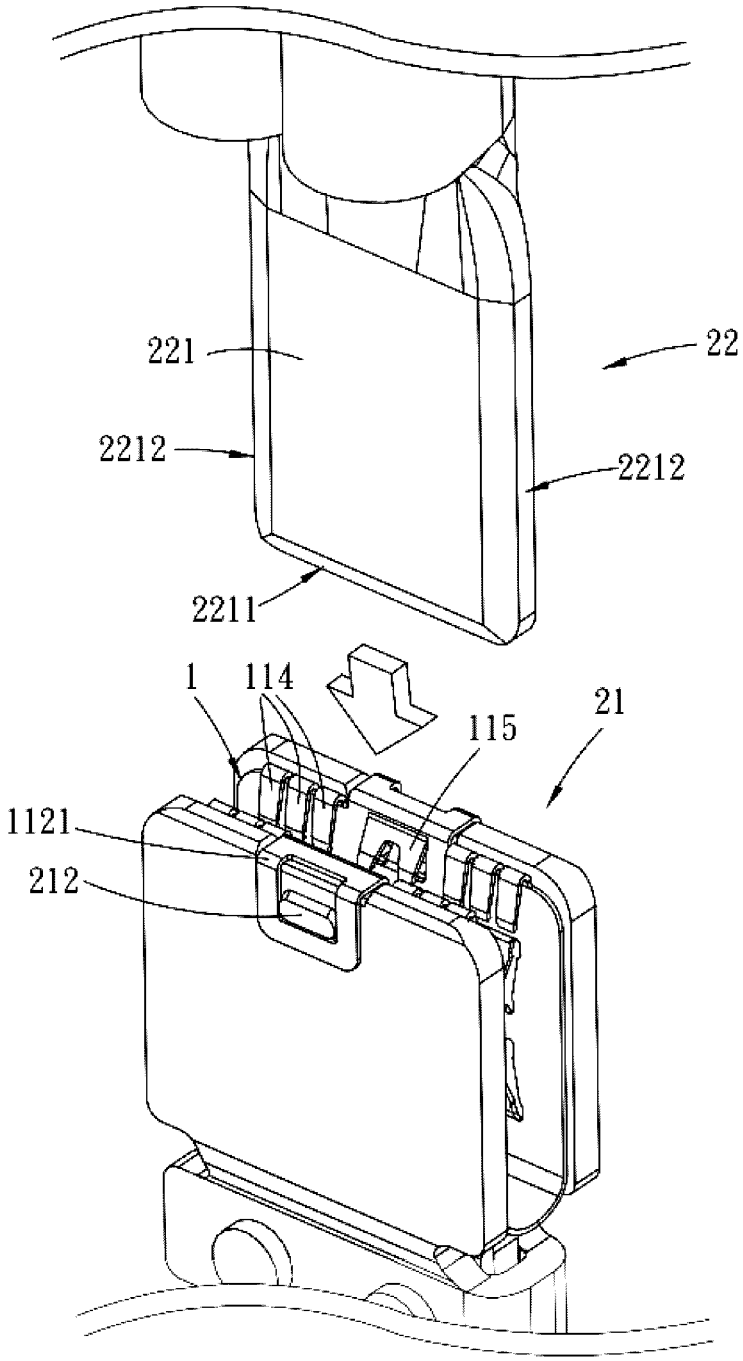
FIG. 6 is a perspective view showing the assembly of an electrical connector of the present disclosure.
Figure 7:
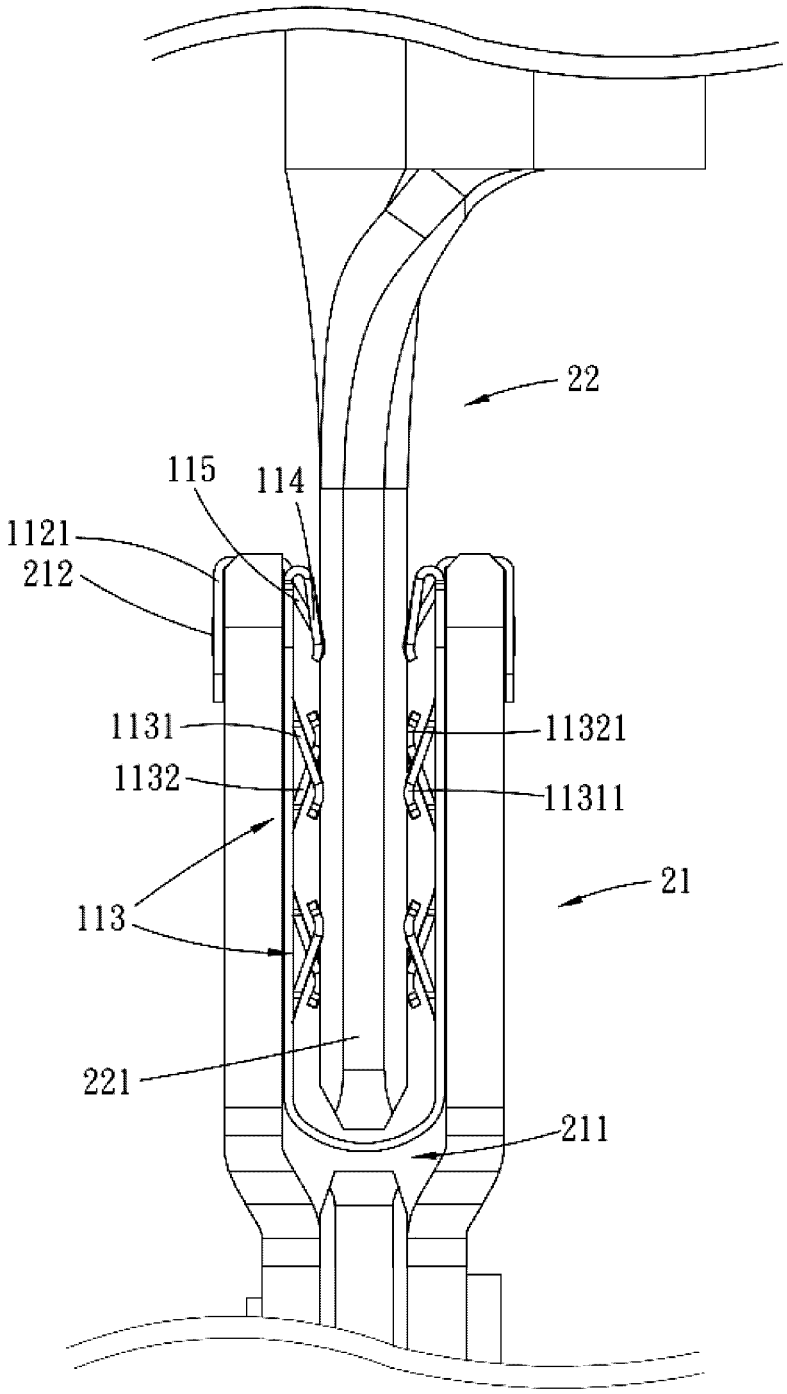
FIG. 7 is a side view of the electrical connector of the present disclosure.

FIG. 6 is a perspective view showing the assembly of an electrical connector of the present disclosure. FIG. 7 is a side view of the electrical connector of the present disclosure. As shown in the figures, in this embodiment, the second electrical connector head 22 comprises an electrical plugging member 221 assembled in the electrical connecting assembly 1. Two side surfaces of the electrical plugging member 221 respectively abut against an electrical contacting component 113 of two electrical connecting parts 11. In this embodiment, the electrical connecting assembly 1 abuts against two side surfaces of the electrical plugging member 221 through a bent contacting part 11311 of a plurality of first contacting pieces 1131 and the bent contacting part 11321 of a plurality of second contacting pieces 1132 of the electrical contacting component 113. In this way, a plurality of electric current contacting points can be provided between the electrical plugging member 221 and the electrical connecting notch 211 assembled with the electrical connecting assembly 1 to distribute the heat generated when electric current is overloaded and to lower the heat generated by corrosion potential to improve the overall current capacity, thereby increasing the service life for the electrical connector.

Moreover, the electrical connecting assembly 1 assembled to the first electrical connector head 21 comprises an electrical contacting component 113. Since the bent contacting parts 11311 of the plurality of first contacting pieces 1131 and the bent contacting parts 11321 of the plurality of second contacting pieces 1132 of the electrical contacting component 113 are bent and extended inward, the plurality of first contacting pieces 1131 and the plurality of second contacting pieces 1132 abut against two side surfaces of the electrical plugging member 221 of the second electrical connector head 22. In this way, the two electrical connecting parts 11 of the electrical connecting assembly 1 could clamp the electrical plugging member 221 to enhance the connection strength and the electrical contacting stability between the first electrical connector head 21 and the second electrical connector head 22.

Besides, the electrical connecting assembly 1 further comprises a plurality of first guiding contact pieces 114 and a second guiding contact piece 115. The plurality of first guiding contact pieces 114 are disposed at two sides of the second guiding contact piece 115. The electrical plugging member 221 is assembled in the electrical connecting assembly 1 through one side having the plurality of first guiding contact pieces 114 and the second guiding contact pieces 115. Two sides of the electrical plugging member 221 are respectively in contact with the plurality of first guiding contact pieces 114 and the second guiding contact pieces 115. In this embodiment, an electrical plugging member 221 is provided along the structural extending direction of the plurality of first guiding contact pieces 114 and the second guiding contact piece 115 to be guided and inserted into the electrical connecting notch 211. Meanwhile, the plurality of first guiding contact pieces 114 and the second guiding contact pieces 115 abut against the two side surfaces of the electrical plugging member 221 to increase the plugging strength of the electrical plugging member 221 inserted in the electrical connecting notch 211.

Referring to FIG. 6, in this embodiment, the plugging end of the electrical plugging member 221 comprises a first side edge 2211 and two second side edges 2212 adjacent to the first side edge 2211. The electrical plugging member 221 is assembled in the electrical connecting notch 211 through an opening of the electrical connecting assembly 1 away from the bending part 13 in a direction along the first side edge 2211, wherein the first electrical connector head 21 and the second electrical connector head 22 are in a 180 degrees insert-assembly, that is, the first electrical connector head 21 and the second electrical connector head 22 are connected straightly.

Figure 8:
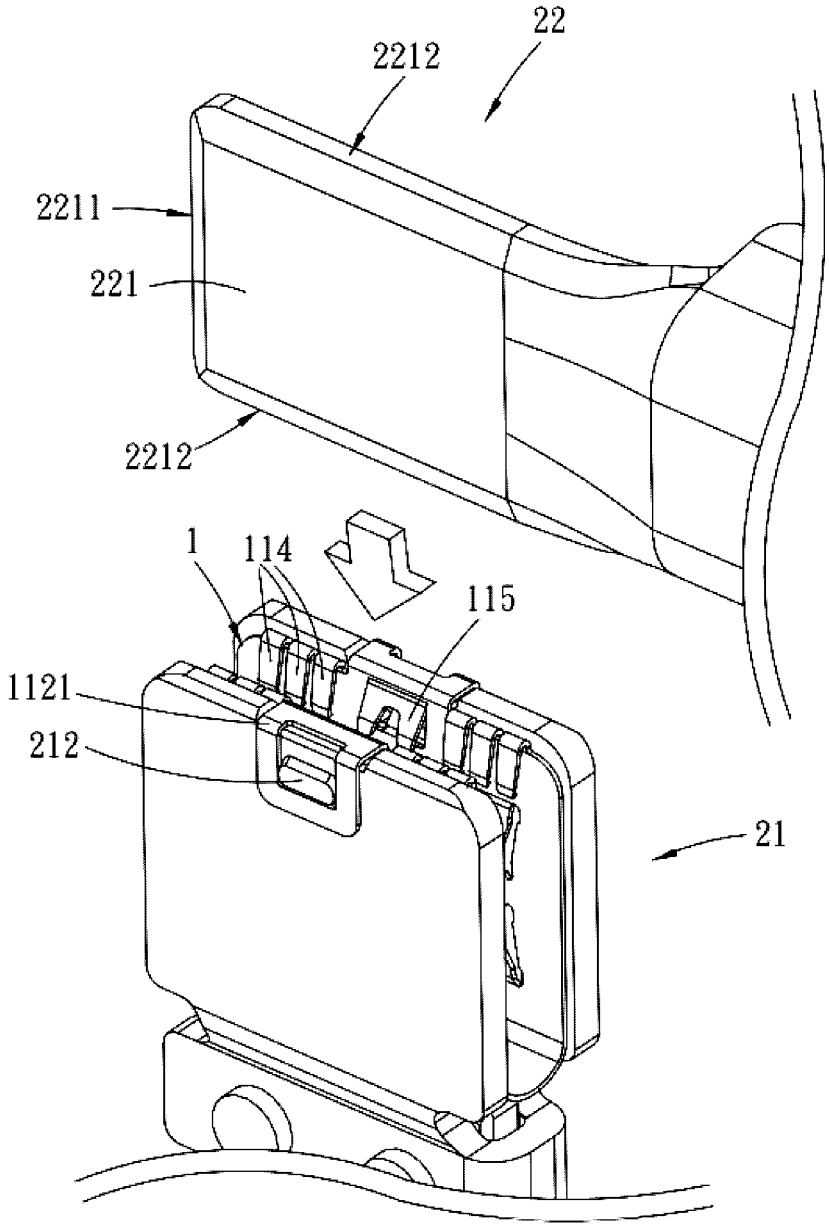
FIG. 8 is another perspective view showing the assembly of an electrical connector of the present disclosure.

FIG. 8 is another perspective view showing the assembly of an electrical connector of the present disclosure. As shown in the figure, in this embodiment, the plugging end of the electrical plugging member 221 comprises a first side edge 2211 and two second side edges 2212 adjacent to the first side edge 2211. The electrical plugging member 221 is assembled in the electrical connecting notch 211 through an opening of the electrical connecting assembly 1 away from the bending part 13 in a direction along the second side edge 2212, wherein the first electrical connector head 21 and the second electrical connector head 22 are in a 90-degree insert-assembly, which indicates that the second electrical connector head 22 is horizontally configured and one end of the second electrical connector head 22 opposite to the first electrical connector head 21 is moving downward to be connected in a right angle assembly.

In this embodiment, the electrical plugging member 221 is limited to be plugged to the electrical connecting notch 211, but the plugging direction is not limited. In this way, there would be no structural or using restrictions due to the limitlessness of the insertion direction between the electrical plugging member 221 and the electrical connecting notch 211 for a highly flexible user experience.

In summary, embodiments of the present disclosure provide an electrical connecting assembly and an electrical connector. By assembling the electrical connector to the first electrical connector head through the electrical connecting assembly and assembling the second electrical connector head to the electrical connecting assembly of the first electrical connector head, and through the configuration of the above electrical connecting assembly, when components are interconnected and the system is in operation, it is possible to distribute the heat generated by overloaded electric current to reduce the heat generated by corrosion potential and to improve the overall current overload capacity. Thus, the overall service life for electrical connectors can be increased. Besides, the strength of the connection between the first electrical connector head and the second electrical connector head and the stability of the electrical contact can be enhanced by the structural configuration of the electrical connecting assembly.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connecting assembly, comprising:

two electrical connecting parts, each of which comprising a main body and a securing component, each of the main bodies comprising an electrical contacting component, each of the securing components being disposed at a side edge of the corresponding main body; and a bending part of which two bent sides being the two electrical connecting parts extending in one direction, the two electrical connecting parts being symmetrically disposed across the bending part, each of the main bodies comprising, a plurality of first guiding contact pieces, disposed at a side edge of the corresponding main bodies away from the bending part, wherein the plurality of first guiding contact pieces extend in a direction facing the bending part and away from the corresponding main body; and a second guiding contact piece, disposed at a side edge of the corresponding main body away from the bending part, having two abutting parts and configured to an M shaped.

2. The electrical connecting assembly according to claim 1, wherein the securing component is arranged on a side edge of the main body away from the bending part.

3. The electrical connecting assembly according to claim 1, wherein each of the electrical contacting components comprises an orifice part, a plurality of first contacting pieces, and a plurality of second contacting pieces; the plurality of first contacting pieces and the plurality of second contacting pieces are alternately disposed at the orifice part.

4. The electrical connecting assembly according to claim 3, wherein the orifice part comprises a first side edge and a second side edge opposite to the first side edge; one ends of the plurality of first contacting pieces are respectively connected with the first side edge at intervals; one ends of the plurality of second contacting pieces are respectively connected with the second side edge at intervals; the plurality of first contacting pieces and the plurality of second contacting pieces are alternately arranged to form a stagger type component.

5. The electrical connecting assembly according to claim 3, wherein one extending ends of the plurality of first contacting pieces comprises a bent contacting part; one extending ends of the plurality of second contacting pieces comprises a bent contacting part.

6. The electrical connecting assembly according to claim 3, wherein an acute angle is formed between the plurality of first contacting pieces and a plane of the orifice part; an acute angle is formed between the plurality of second contacting pieces and a plane of the orifice part.

7. The electrical connecting assembly according to claim 1, wherein the two electrical connecting parts and the connecting bending part are integrally formed.

8. An electrical connector, comprising:

a first electrical connector head comprising an electrical connecting notch and the electrical connecting assembly according to claim 1, the electrical connecting assembly being assembled to the electrical connecting notch, the securing component being secured to the first electrical connector head;

wherein a second electrical connector head is provided, which comprises an electrical plugging member assembled in the electrical connecting assembly; two side surfaces of the electrical plugging member respectively abut against the electrical contacting components of the two electrical connecting parts.

9. The electrical connector according to claim 8, wherein the securing component is a securing buckle; an outer sidewall of the first electrical connector head comprises a securing bump; the securing buckle is buckled to the securing bump.

10. The electrical connector according to claim 8, wherein a plugging end of the electrical plugging member comprises a first side edge and two second side edges adjacent to the first side edge; the electrical plugging member passes through an opening of the electrical connecting assembly away from the bending part to be assembled in the electrical connecting notch in a direction along the first side edge or the second side edge; wherein the first electrical connector head and the second electrical connector head are in a 180 degrees or 90 degrees assembly.

11. The electrical connector according to claim 8, wherein the electrical connecting assembly further comprises two groups of guiding contact pieces that each one of the two groups having the plurality of first guiding contact pieces and the second guiding contact piece that are corresponding to the same main body; the plurality of first guiding contact pieces are disposed at two sides of the corresponding second guiding contact piece; the electrical plugging member is assembled in the electrical connecting assembly through one side having the two groups of guiding contact pieces; the two side surfaces of the electrical plugging member are respectively in contact with one of the two groups of guiding contact pieces.

* * * * *